US007104367B2

(12) United States Patent
Ferrand et al.

(10) Patent No.: US 7,104,367 B2
(45) Date of Patent: Sep. 12, 2006

(54) MODULAR AND ADAPTABLE BRAKE SYSTEM FOR AN ELEVATOR SHEAVE

(75) Inventors: Gilles Ferrand, Saint Barthelemy D'Anjou (FR); Bruno Pitto, Angers (FR)

(73) Assignee: Warner Electric Europe S.A.S., (FR)

( * ) Notice: Subject to any disclaimer, the term of this patent is extended or adjusted under 35 U.S.C. 154(b) by 328 days.

(21) Appl. No.: 10/448,653

(22) Filed: May 30, 2003

(65) Prior Publication Data

US 2004/0251088 A1 Dec. 16, 2004

(51) Int. Cl.
*B65H 59/00* (2006.01)

(52) U.S. Cl. ..... 188/170; 188/171; 188/196 M

(58) Field of Classification Search ..... 188/166, 188/171, 196 M, 28, 170; 254/375, 378, 254/379

See application file for complete search history.

(56) References Cited

U.S. PATENT DOCUMENTS

| | | | | |
|---|---|---|---|---|
| 4,739,969 | A | 4/1988 | Eckersley et al. | |
| 4,923,055 | A | 5/1990 | Holland | |
| 4,977,982 | A | 12/1990 | Bialy et al. | |
| 5,007,505 | A | 4/1991 | Lindegger | |
| 5,101,939 | A | 4/1992 | Sheridan | |
| 5,109,958 | A * | 5/1992 | Kato et al. | 187/254 |
| 5,435,209 | A | 7/1995 | Wittur | |
| 5,669,469 | A | 9/1997 | Ericson et al. | |
| 5,873,434 | A | 2/1999 | Sugita et al. | |
| 5,944,150 | A | 8/1999 | Hikari | |
| 6,371,248 | B1 | 4/2002 | Cholinski | |
| 6,439,355 | B1 * | 8/2002 | Kimble | 188/171 |
| 6,520,299 | B1 | 2/2003 | Rimann et al. | |
| 6,659,237 | B1 * | 12/2003 | Pribonic | 188/165 |

FOREIGN PATENT DOCUMENTS

| | | |
|---|---|---|
| JP | 11 335041 A | 7/1999 |
| JP | 2002020064 A | 1/2002 |

* cited by examiner

*Primary Examiner*—James McClellan
*Assistant Examiner*—Bradley T. King
(74) *Attorney, Agent, or Firm*—Dykema Gossett PLLC

(57) ABSTRACT

An adjustable brake is provided that applies a braking force directly to an elevator sheave over which a cable suspends an elevator car and a counterweight. The brake includes a pair of calipers that apply a braking force to either longitudinal end of the sheave. The brake is spring set and may be released using, for example, electromagnetic, hydraulic or pneumatic forces. The calipers are mounted to and movable along a rail to enable adjustment of the location of the calipers. Further, the calipers are coupled together using one or more pins and are movable along the pins to enable adjustment of spacing between the calipers. The brake is particularly adapted for use with existing elevators because the brake does not require modification to the existing elevator sheave.

17 Claims, 5 Drawing Sheets

MODULAR AND ADAPTABLE BRAKE SYSTEM FOR AN ELEVATOR SHEAVE

BACKGROUND OF THE INVENTION

1. Field of the Invention

This invention relates to brakes used in elevators and, in particular, to a brake that applies a braking force directly to an elevator sheave and that is configured for use in existing elevators without requiring modification of the elevators.

2. Discussion of Related Art

A conventional elevator includes an elevator car and a counterweight disposed within an elevator shaft at opposite ends of a plurality of cables. Portions of each cable intermediate the elevator car and the counterweight are disposed within grooves formed in the circumference of a sheave that is located above the elevator car and counterweight and is rotatably driven by a motor to control the ascent and descent of the elevator car. One or more gears may be disposed between the motor and sheave or the sheave may be directly rotated by the motor. The sheave, motor, and any motor controls may be located within a control room above the elevator shaft or within the elevator shaft itself. The elevator car and counterweight move upward and downward within the elevator shaft on rails.

Conventional elevators also include one or more emergency braking systems to prevent the elevator car from ascending or descending too quickly in the event of a system failure such as a broken cable. The brakes may be applied in a variety of locations. For example, some brakes are mounted between the elevator car and the rails on which the elevator car rides. These brakes produce rough braking and may inflict damage to the elevator car rails. Further, these brakes are difficult to install in existing elevators. Another type of brake apply a braking force directly to the cables in the elevator. This type of brake may inflict damage to the cables (requiring extensive inspection and downtime for the elevator) and is difficult to install in existing elevators. Another type of conventional brake includes a disc mounted coaxially with the elevator sheave and an actuator that applies a braking force to one side of the disc while another type of conventional brake includes calipers that apply a braking force to either side of a disc or to a shaft. These type of brake requires modifications in existing elevators and the caliper brakes are also generally limited to use with discs of certain widths. Yet another type of conventional brake applies a braking force to the outer or inner diameter of the sheave. This type of brake also requires extensive modifications in existing elevators (e.g., machining flats or bosses on the sheave surface) and the friction material in the brake must often be specially adapted for use with the sheave. U.S. Pat. No. 4,923,055 discloses a brake including two calipers that apply a braking force to either longitudinal end of the sheave. This brake is also unsuitable for use with existing elevators, however, as the brake actuator relies on bosses machined into an inner diameter at one end of the sheave.

Conventional elevator brakes therefore have significant disadvantages. In particular, conventional elevator brakes-while suitable for use in new elevators—are not adapted for ease of installation and use in existing elevators. The inventors herein have recognized a need for an elevator brake that will minimize and/or eliminate one or more of the above-identified deficiencies.

SUMMARY OF THE INVENTION

The present invention provides a brake for selectively inhibiting rotation of a sheave supporting at least one cable connected to an elevator car and a counterweight.

A brake in accordance with one embodiment of the present invention includes first and second calipers arranged for selective engagement with first and second longitudinal ends of the sheave, respectively. Each of the first and second calipers includes a first plate, a second plate that is movable relative to the first plate, and a spring biasing the second plate in a first direction away from the first plate and towards a corresponding end of the first and second longitudinal ends of the sheave. Each of the first and second calipers further includes means for selectively urging the second plate in a second direction opposite the first direction. The urging means may apply, for example, an electromagnetic force, a hydraulic force, or a pneumatic force to urge the second plate in the second direction.

A brake in accordance with the present invention represents and improvement as compared to conventional elevator brakes. In particular, the inventive brake is configured for use with existing elevators without requiring modification of the elevator. The inventive brake applies a braking force directly to the elevator sheave without any modification to the sheave and is adaptable to wide variations in the width and diameter of the sheave as well as variations in load.

These and other advantages of this invention will become apparent to one skilled in the art from the following detailed description and the accompanying drawings illustrating features of this invention by way of example.

DETAILED DESCRIPTION OF ONE OR MORE EMBODIMENTS OF THE INVENTION

Figure 1:
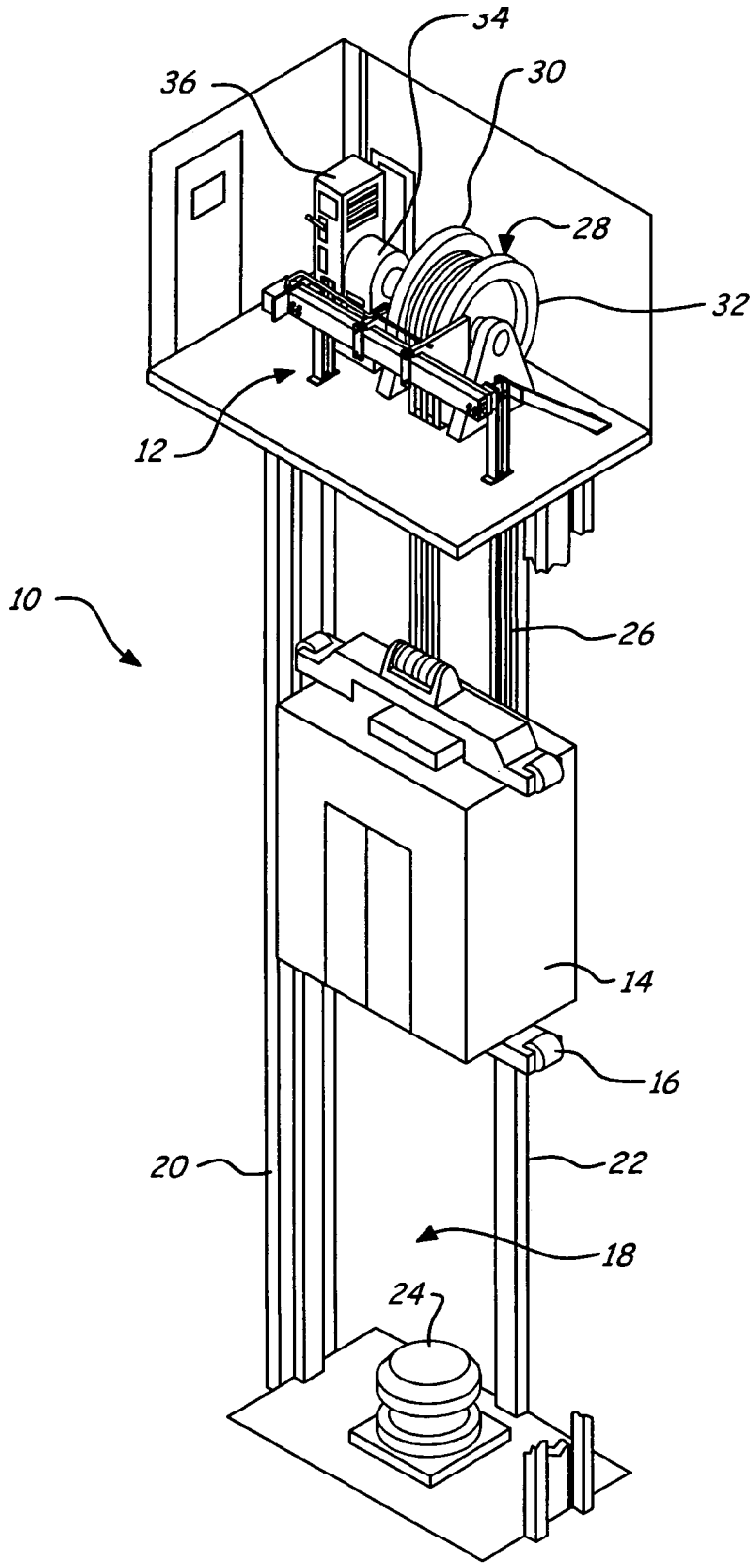
FIG. 1 is a perspective view of a conventional elevator incorporating a brake in accordance with one embodiment of the present invention.

Referring now to the drawings wherein like reference numerals are used to identify identical components in the various views, FIG. 1 illustrates an elevator 10 incorporating a brake 12 in accordance with one embodiment of the present invention. Although FIG. 1 illustrates a conventional passenger or freight elevator, it should be understood that the inventive brake 12 may find application in other similar devices such as dumbwaiters, hoists, cranes and escalators and other lifting equipment. Further, although brake 12 offers the significant advantage of use on existing elevators, it should be understood that brake 12 could also be used in new elevators.

Elevator 10 is conventional in the art. Elevator 10 includes an elevator car 14 and a counterweight 16 disposed within an elevator shaft 18. Car 14 and counterweight 16 ascend and descend within shaft 18 on rails 20, 22, respectively. A stop 24 disposed at the bottom of shaft 18 cushions car 14 at is lowest point of descent. Car 14 and counterweight 16 are disposed at opposite ends of a plurality of cables 26. Cables 26 extend over a sheave 28 located above car 14 and counterweight 16 in a control room 28 or proximate the top of the elevator shaft. Cables 26 rest within grooves (not shown) formed in sheave 28 intermediate the longitudinal ends 30, 32 of sheave 28. Sheave 28 may be rotatably driven by a motor 34 subject to conventional motor controls 36. Alternatively, sheave 28 may be driven by other actuators (e.g., hydraulic actuation).

Figure 2:
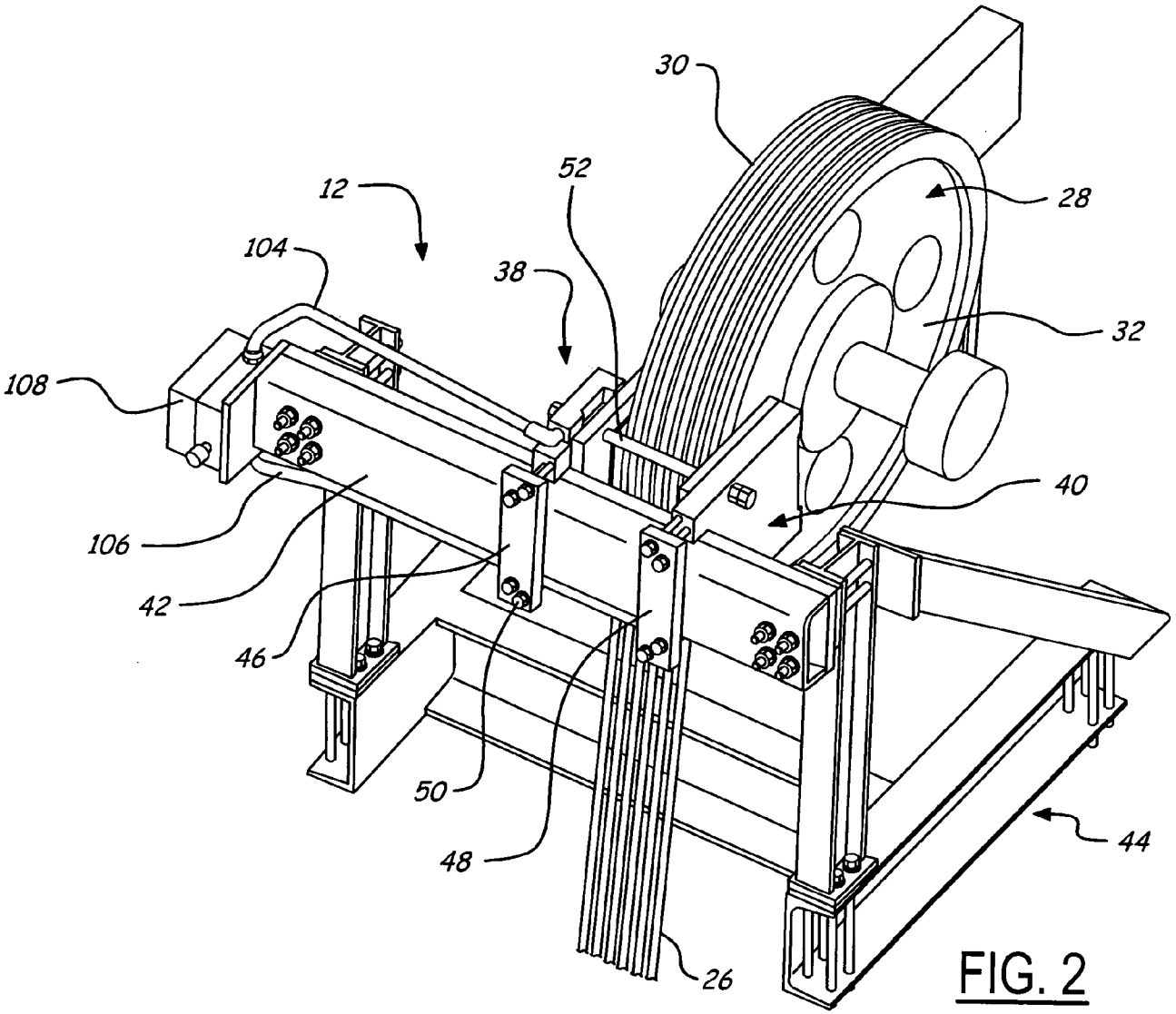
FIGS. 2–3 are perspective views of a brake in accordance with one embodiment of the invention as applied against an elevator sheave.
Figure 3:
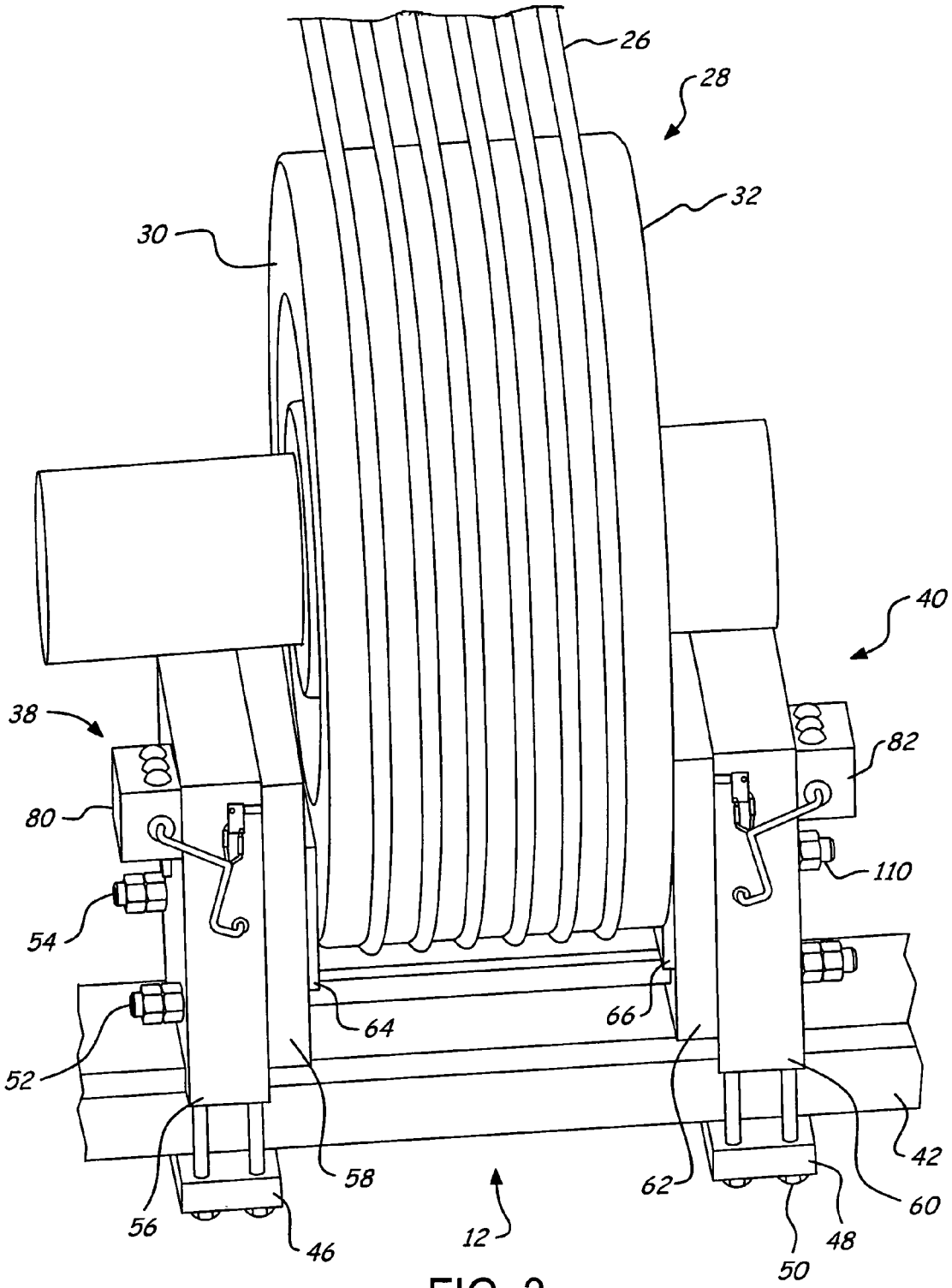
Figure 4:
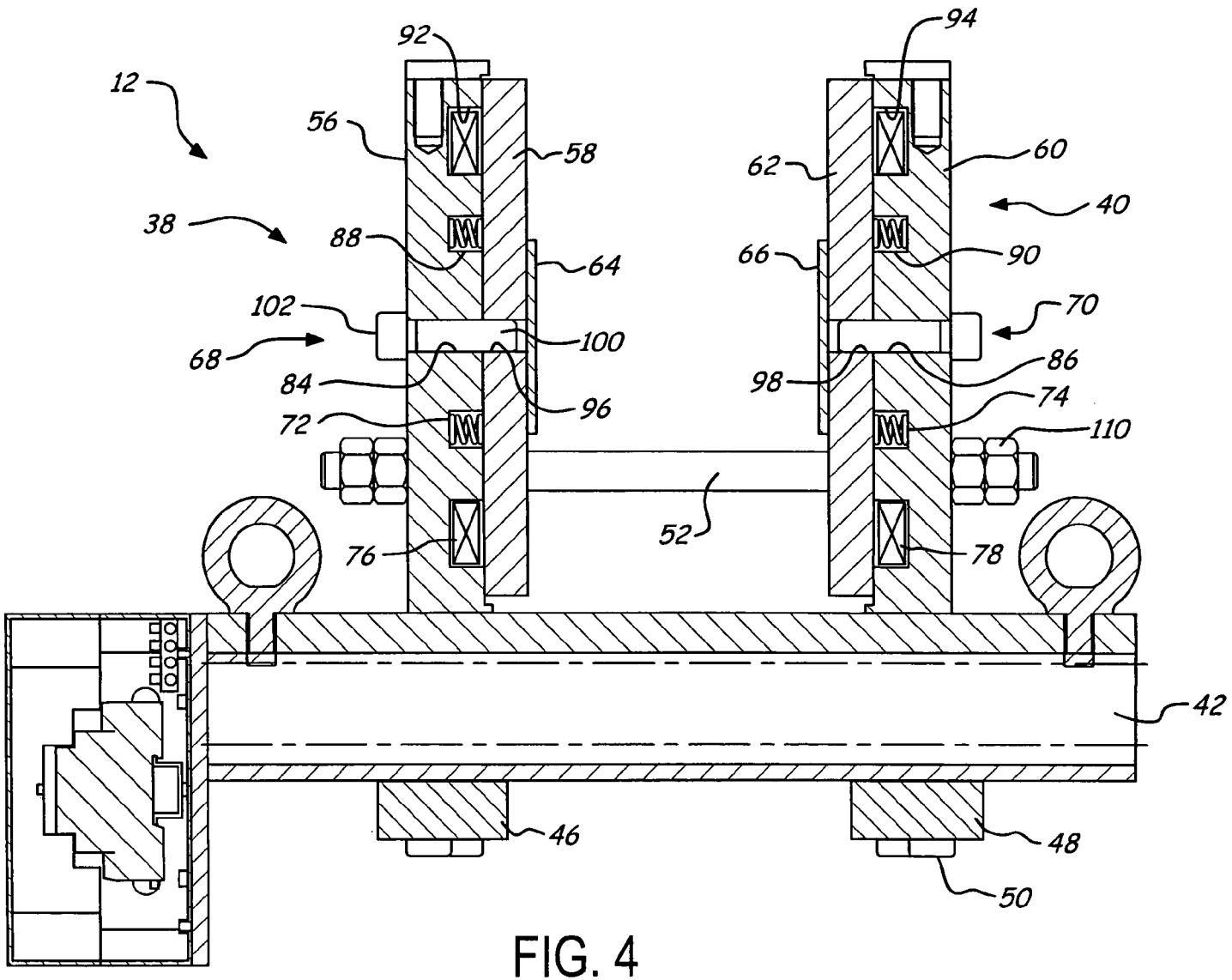
FIG. 4 is a cross-sectional view of a brake in accordance with one embodiment of the present invention.

Referring now to FIGS. 2–4, a brake 12 in accordance with one embodiment of the present invention for inhibiting rotation of a sheave 28 supporting at least one cable 26 connected to an elevator car 14 and a counterweight 16 will be described. Brake 12 may include first and second calipers 38, 40, a rail 42, means, such as frame 44, for locating and supporting rail 42, means, such as plates 46, 48 and fasteners 50, for mounting calipers 38, 40 to rail 42 and means, such as pins 52, 54, for adjusting the spacing of calipers 38, 40.

Calipers 38, 40 are provided to apply a braking force to ends 30, 32 of sheave 28. In the illustrated embodiment, calipers 38, 40 are substantially the same in construction. It should be understood, however, that the construction of each caliper 38, 40 may vary. It should also be understood that additional calipers could be employed to assist calipers 38, 40. Calipers 38, 40 may include plates 56, 58 and 60, 62, friction pads 64, 66, pins 68, 70, springs 72, 74, and means for selectively urging plates 58, 62 in one direction towards plates 56, 60. The urging means may comprise means for generating an electromagnetic force to urge plates 58, 62 towards plates 56, 60. The generating means may include coils 76, 78 and means, such as controllers 80, 82 (best shown in FIG. 3), for selectively energizing coils 76, 78.

Plates 56, 60 provide structural support for the other components of calipers 38, 40. Plates 56, 60 may be made from a material having a relatively low magnetic reluctance such as a metal alloy. Plates 56, 60 are substantially square in the illustrated embodiment, but it should be understood that the shape of plates 56, 60 may be varied without departing from the spirit of the present invention. Plates 56, 60 may include through bores 84, 86 configured to receive pins 68, 70 coupling plates 56, 60 to plates 58 62, through bores (not shown) configured to receive pins 52, 54 extending between calipers 38, 40, and recesses 88, 90 and 92, 94 configured to receive springs 72, 74 and coils 76, 78.

Plates 58, 62 are provided to apply a braking force against ends 30, 32 of sheave 28. Plates 58, 62 may also be made from a material having a relatively low magnetic reluctance such as a metal alloy. In the illustrated embodiment, plates 58, 62 are substantially square in shape and slightly smaller in dimension than plates 56, 60. It should again be understood, however, that the size and shape of plates 58, 62 may be varied without departing from the spirit of the present invention. Plates 58, 62 may include bores 96, 98 configured to receive pins 68, 70 coupling plates 56, 60 to plates 58, 62 and through bores (not shown) configured to receive pins 52, 54 extending between calipers 38, 40. Because plates 58, 62 of calipers 38, 40 apply a braking force to sheave 28 rather than a less structurally sound component of elevator 10 such as rails 20, 22 or cables 26, brake 12 is less likely to damage elevator 10 than conventional brakes. Further, brake 12 may be repeatedly set and released without requiring inspection, repair or downtime to the elevator.

Friction pads 64, 66 are provided to increase the friction between calipers 38, 40 and sheave 28 and are conventional in the art. Friction pads 64, 66 may be affixed to plates 58, 62 using an adhesive or another conventional fastener.

Pins 68, 70 are provided to couple plates 56, 60 and plates 58, 62 to one another, respectively, but allow for movement of plates 58, 62 relative to plates 56, 60. Each pin 68, 70 includes a shank 100 extending through bores 84, 86 and 96, 98 of plates 56, 60 and plates 58, 62 and a head 102 disposed on one side of plates 56, 60 opposite plates 58, 62.

Springs 72, 74 are provided to bias plates 58, 62 in one direction away from plates 56, 60 and towards a corresponding end 30, 32 of sheave 28 to set brake 12. Springs 72, 74 may be made from conventional materials. Springs 72, 74 are disposed within recesses 88, 90 in plates 56, 60. Because each caliper 38, 40 includes springs 72, 74, brake 12 has redundant braking capabilities and improves elevator safety. Further, each of calipers 38, 40 may include a plurality of springs 72, 74 to ensure each caliper 38, 40 of brake 12 is set in the event of a failure of any one spring 72, 74 for that caliper 38, 40. Springs 72, 74 may be evenly spaced in a circle or in concentric circles. However, it will be understood that other arrangements are possible.

Coils 76, 78 are provided to create an electromagnetic force attracting plates 58, 62 towards plates 56, 60 and away from ends 30, 32 of sheave 28 to release brake 12. Coils 76, 78 may also be made from conventional materials such as copper. Coils 76, 78 are disposed within recesses 92, 94 in plates 56, 60. In the illustrated embodiment, coils 76, 78 are disposed radially outwardly of springs 72, 74. The relative radial position of springs 72, 74 and coils 76, 78 may be reversed, however, without departing from the spirit of the present invention.

Controllers 80, 82 are provided to selectively energize coils 76, 78. Controllers 80, 82 may comprise programmable microcontrollers or discrete circuits that selectively energize coils 76, 78 responsive to a predetermined condition (e.g., a rapid ascent of car 14) as detected by, for example, conventional speed sensors. Referring to FIG. 2, controllers 80, 82 may be powered and transmit and receive control signals through cables 104, 106 or buses from a central controller 108 mounted at one end of rail 42. The programming of controllers 80, 82, 108 is considered to be part of the ordinary skill in the art.

Rail 42 is provided to allow adjustment of the longitudinal location of calipers 38, 40 relative to sheave 28 and provides structural support for handling braking torque. Rail 42 extends parallel to the axis of rotation of sheave 28. Rail 42 may be tubular and substantially rectangular in cross-section. It should be understood, however, that the size, shape and configuration of rail 42 may be varied without departing from the spirit of the present invention.

Frame 44 is provided to locate and support rail 42 relative to sheave 28. Rail 42 may be mounted to frame 44 using bolts, screws, or other conventional fasteners. It should be understood that frame 44 may be constructed in a variety of ways. It should also be understood that frame 44 is not required to locate and support rail 42 and that rail 42 may be located and supported relative to sheave 28 in a variety of ways.

Plates 46, 48 and fasteners 50 are provided to mount calipers 38, 40 to rail 42. Plates 48, 50 are disposed on one side of rail 42 while calipers 38, 40 are disposed on an opposite side of rail 42. Fasteners 50 extend through plates 46, 48 and into calipers 38, 40 and couple plates 46, 48 to calipers 38, 40 on opposite sides of rail 42. In the illustrated embodiment, each caliper 38, 40 is coupled to a corresponding plate 46, 48 using four fasteners 50 (two on each side of rail 42). It should be understood, however, that the number of fasteners 50 may be varied without departing from the spirit of the present invention. Fasteners 50 may comprise screws, bolts, pins, or other conventional fasteners. The mounting arrangement of calipers 38, 40 on rail 42 enables calipers 38, 40 to be easily moved along rail 42 to enable adjustment of calipers 38, 40 relative to sheave 28.

Pins 52, 54 provide a means for adjusting the spacing of calipers 38, 40. Pins 52, 54 extend between calipers 38, 40 and couple calipers 38, 40, extending through plates 56, 60 and 58, 62 in calipers 38, 40. At least one of calipers 38, 40 is movable along pins 52, 54 to adjust the spacing between calipers 38, 40. Nuts 110 may be disposed on either end of pins 52, 54 to secure the location of calipers 38, 40 on pins 52, 54. In the illustrated embodiment, two pins 52, 54 extend between calipers 38, 40. It should be understood, however, that the number of pins 52, 54 may be varied without departing from the spirit of the present invention. The use of pins 52, 54 enables brake 12 to be used with a wide variety of sheaves 28 and further facilitates use of brake 12 with existing elevators.

Figure 5:
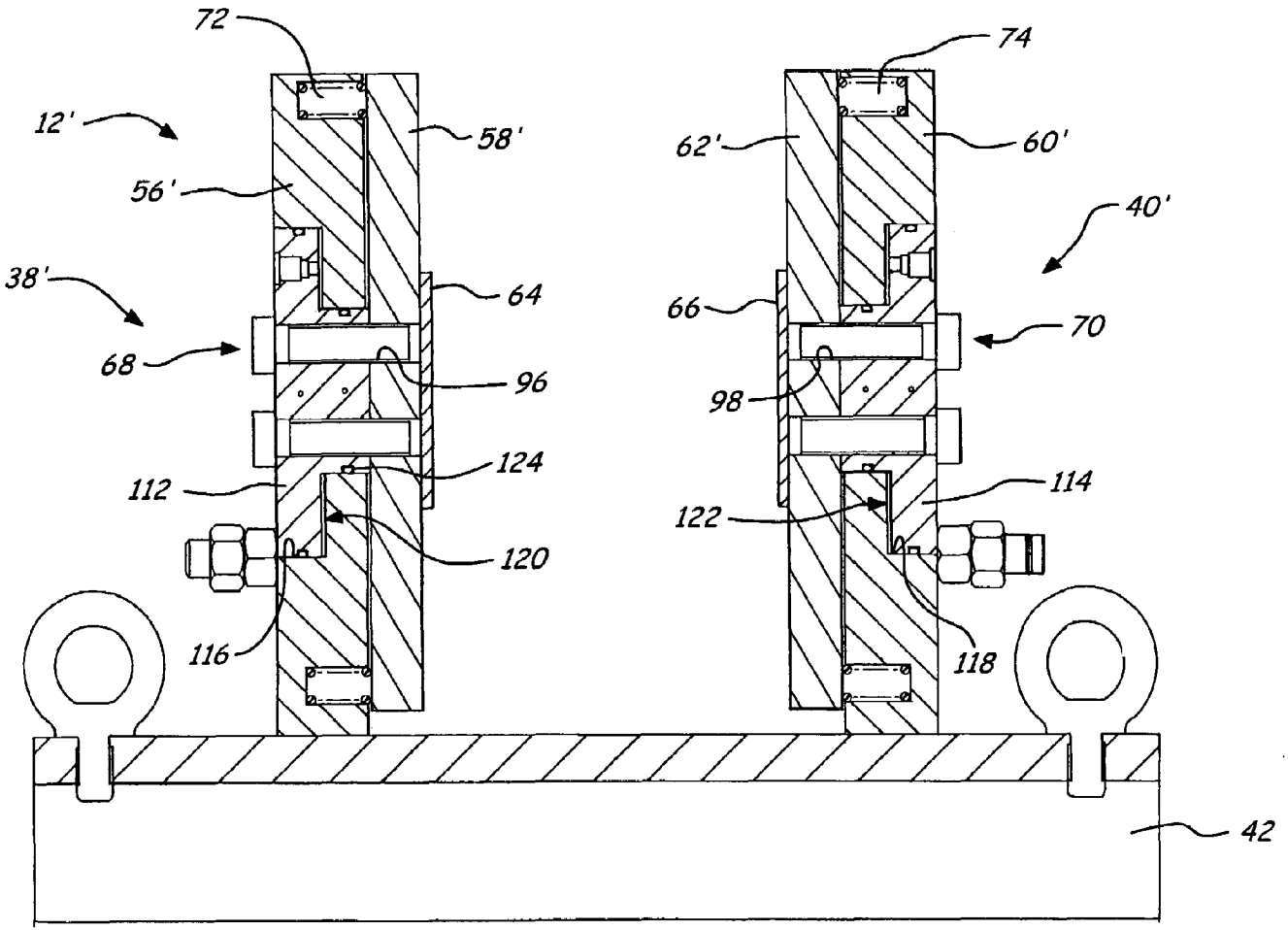
FIG. 5 is a cross-sectional view of a brake in accordance with another embodiment of the present invention.

Referring now to FIG. 5, a brake 12' in accordance with another embodiment of the present invention for inhibiting rotation of a sheave 28 supporting at least one cable 26 connected to an elevator car 14 and a counterweight 16 will be described. Brake 12' is substantially similar to brake 12 and, therefore, similar components will not be described in detail. Brake 12' may include first and second calipers 38', 40'. Brake 12' may again include a rail 42, means, such as frame 44, for locating and supporting rail 42, means, such as plates 46, 48 and fasteners 50, for mounting calipers 38', 40' to rail 42 and means, such as pins 52, 54, for adjusting the spacing of calipers 38', 40'.

Calipers 38', 40' are provided to apply a braking force to ends 30, 32 of sheave 28. In the illustrated embodiment, calipers 38', 40' are again substantially the same in construction. It should be understood, however, that the construction of each caliper 38', 40' may vary. Calipers 38', 40' may include plates 56' 58' and 60', 62', friction pads 64, 66, pins 68, 70, springs 72, 74, and means for selectively urging plates 58', 62' in one direction towards plates 56', 60'. The urging means may include pistons 112, 114 coupled to plates 58', 62' and means for applying fluid pressure against pistons 112, 114 to urge pistons 112, 114 and plates 58', 62' in one direction towards plates 56', 60' and away from ends 30, 32 of sheave 28.

Plates 56', 60' provide structural support for the other components of calipers 38', 40' and are substantially similar to plates 56, 60 of brake 12. Plates 56', 60' define cylinders having stepped apertures 116, 118 in which pistons 112, 114 are disposed. Plates 58', 62' are disposed on one side of plates 56', 60' and include bores 96, 98 configured to receive pins 68, 70 extending through pistons 112, 114. Springs 72, 74 are provided to bias plates 58', 62' in one direction away from plates 56', 60' and towards a corresponding end 30, 32 of sheave 28 to set brake 12. Each of calipers 38', 40' may again include a plurality of springs 72, 74 to ensure brake 12 is set in the event of a failure of any one of springs 72,74. Springs 72, 74 may be disposed radially outwardly of pistons 112, 114.

Pistons 112, 114 are coupled to plates 58', 62' using pins 68, 70 or other fasteners. Pistons 112, 114 are disposed with apertures 116, 118 in plates 56', 60' and are shaped complementary to apertures 116, 118 with each of pistons 112, 114 and plates 56', 60' defining radially inner and outer shoulders. Pistons 112, 114 and plates 56', 60' define fluid cavities 120, 122 between these shoulders. Seals 124 are disposed in grooves in pistons 112, 114 on either side of fluid cavities 120, 122 to prevent the loss of fluid pressure.

Brake 12' further includes means for applying fluid pressure to pistons 112, 114 to thereby urge pistons 112, 114 in one direction. This action urges plates 58', 62' towards plates 56', 60' and away from sheave 28 to release brake 12'. The fluid pressure may be hydraulic or pneumatic and may be supplied in a conventional manner responsive to mechanical or electrical controls detecting a predetermined operating condition of elevator 10.

A brake in accordance with the present invention represents a significant improvement as to conventional elevator brakes. First, the inventive brake is configured for use with existing elevators without requiring modification to the components of the elevator. The inventive brake is also capable of accommodating a wide variety of sheave widths and diameters and varying loads found in existing elevators. Second, the inventive brake is less likely to damage components of the elevator upon application of the brake, thereby limiting elevator downtime and repair costs, because the brake is applied to the sheave rather than weaker components such as the rails or cables. Third, the inventive brake provides braking redundancy in the event of a failure because each caliper is separately controlled. Fourth, the inventive brake can be repeatedly set and released without requiring extensive manual resetting between actuations. Fifth, the inventive brake enables application of braking force to the elevator that provides a smoother deceleration of the elevator as compared to some conventional brakes that apply a braking force to the rails or cables.

While the invention has been shown and described with reference to one or more particular embodiments thereof, it will be understood by those of skill in the art that various changes and modifications can be made without departing from the spirit and scope of the invention. For example, although the illustrated embodiments illustrate electromagnetic and fluid (hydraulic or pneumatic) actuators for releasing the brake, it should be understood that other electrical or mechanical actuation could be employed.

We claim:

1. A brake for selectively inhibiting rotation of a sheave supporting at least one cable connected to an elevator car and a counterweight, said brake comprising:

first and second calipers arrainged for selective engagement with first and second longitudinal ends of said sheave, respectively, each of said first and second calipers including:

a first plate;

a second plate movable relative to said first plate;

a spring biasing said second plate in a first direction away from said first plate and towards a corresponding end of said first and second longitudinal ends of said sheave; and, means for selectively urging said second plate in a second direction opposite said first direction;

a rail extending parallel to the axis of rotation of said sheave, said first and second calipers mounted to and movable along said rail; and, a pin extending between and coupling said first and second calipers, at least one of said first and second calipers movable along said pin to adjust a spacing between said first and second calipers.

2. The brake of claim 1 wherein each of said first and second calipers further includes a second spring biasing said second plate in a first direction away from said first plate and towards a corresponding end of said first and second longitudinal ends of said sheave.

3. The brake of claim 1 wherein said urging means comprises means for selectively generating an electromagnetic force to urge said second plate in said second direction.

4. The brake of claim 3 wherein said generating means includes:

a coil disposed in a recess within said first plate; and means for selectively energizing said coil.

5. The brake of claim 1 wherein said urging means includes:

a piston coupled to said second plate; and means for applying fluid pressure against said piston to urge said piston in said second direction.

6. The brake of claim 5 wherein said fluid pressure comprises hydraulic fluid pressure.

7. The brake of claim 5 wherein said fluid pressure comprises pneumatic fluid pressure.

8. A brake for selectively inhibiting rotation of a sheave supporting at least one cable connected to an elevator car and a counterweight, said brake comprising:

first and second calipers arranged for selective engagement with first and second longitudinal ends of said sheave, respectively, each of said first and second calipers including:

a first plate;

a second plate movable relative to said first plate;

a spring biasing said second plate in a first direction away from said first plate and towards a corresponding end of said first and second longitudinal ends of said sheave;

a coil disposed in a recess within said first plate; and, means for selectively energizing said coil to thereby urge said second plate in a second direction opposite said first direction a rail extending parallel to the axis of rotation of said sheave, said first and second calipers mounted to and movable along said rail; and a pin extending between and coupling said first and second calipers wherein at least one of said first and second calipers is movable along said rail and said pin to adjust the location and spacing of said first and second calipers.

9. The brake of claim 8 wherein each of said first and second calipers further includes a second spring biasing said second plate in a first direction away from said first plate and towards a corresponding end of said first and second longitudinal ends of said sheave.

10. A brake for selectively inhibiting rotation of a sheave supporting at least one cable connected to an elevator car and a counterweight, said brake comprising:

first and second calipers arranged for selective engagement with first and second longitudinal ends of said sheave, respectively, each of said first and second calipers including:

a first plate;

a second plate movable relative to said first plate;

a spring biasing said second plate in a first direction away from said first plate and towards a corresponding end of said first and second longitudinal ends of said sheave; and, means for selectively urging said second plate in a second direction opposite said first direction, a rail extending parallel to the axis of rotation of said sheave, said first and second calipers mounted to and movable along said rail and a pin extending between and coupling said first and second calipers wherein at least one of said first and second calipers is movable along said rail and said pin to adjust the location and spacing of said first and second calipers.

11. The brake of claim 10 wherein each of said first and second calipers further includes a second spring biasing said second plate in a first direction away from said first plate and towards a corresponding end of said first and second longitudinal ends of said sheave.

12. The brake of claim 10 wherein said urging means comprises means for selectively generating an electromagnetic force to urge said second plate in said second direction.

13. The brake of claim 12 wherein said generating means includes:

a coil disposed in a recess within said first plate; and means for selectively energizing said coil.

14. The brake of claim 1 wherein said urging means includes:

a piston coupled to said second plate; and means for applying fluid pressure against said piston to urge said piston in said second direction.

15. The brake of claim 14 wherein said fluid pressure comprises hydraulic fluid pressure.

16. The brake of claim 14 wherein said fluid pressure comprises pneumatic fluid pressure.

17. The brake of claim 10, further comprising:

first and second mounting plates disposed on one side of said rail opposite said first and second calipers; and, first and second fasteners respectively coupling said first and second mounting plates to said first and second calipers.

* * * * *